US006077141A

United States Patent [19]

Meyer et al.

[11] Patent Number: 6,077,141

[45] Date of Patent: Jun. 20, 2000

[54] PROCESS FOR MANUFACTURING A VACUUM FIELD EMITTER DEVICE CONTAINING HYDROGEN AND APPARATUSES FOR USING THIS PROCESS

[75] Inventors: Robert Meyer, St Nazaire les Eymes; Michel Levis; Jean-Charles Souriau, both of Grenoble, all of France

[73] Assignee: Commissariat a l'Energie Atomique, Paris, France

[21] Appl. No.: 08/955,363

[22] Filed: Oct. 21, 1997

[30] Foreign Application Priority Data

Oct. 28, 1996 [FR] France ..... 96 13127

[51] Int. Cl.[7] ..... H01J 9/00; H01J 9/16; H01J 9/32

[52] U.S. Cl. ..... 445/25; 445/24

[58] Field of Search ..... 445/24, 25, 41, 445/42

[56] References Cited

U.S. PATENT DOCUMENTS

| | | | |
|---|---|---|---|
| 3,552,818 | 1/1971 | Benda . | |
| 5,688,708 | 11/1997 | Kato et al. | 437/51 |
| 5,788,551 | 8/1998 | Dynka et al. | 442/25 |

FOREIGN PATENT DOCUMENTS

WO 96/01492 1/1996 WIPO .

*Primary Examiner*—Nimeshkumar D. Patel
*Assistant Examiner*—Michael J. Smith
*Attorney, Agent, or Firm*—Oblon, Spivak, McClelland, Maier & Neustadt, P.C.

[57] ABSTRACT

A vacuum field emitter device is manufactured by assembling elements of the device, including at least one getter, under a vacuum or a controlled atmosphere. The assembly step includes a step in which elements are positioned, an oven drying step and a device sealing step. Each getter is hydrogenated after the oven drying. The manufacturing process has applications in the manufacture of television screens.

12 Claims, 3 Drawing Sheets

PROCESS FOR MANUFACTURING A VACUUM FIELD EMITTER DEVICE CONTAINING HYDROGEN AND APPARATUSES FOR USING THIS PROCESS

DESCRIPTION

1. Technical Field

This invention relates to a process for manufacturing a device using a microtip electron source in a general manner, and more particularly a process for manufacturing a field emitter device, i.e. a flat cathode ray display screen excited by field emission, or cold emission, by means of microtips.

This type of device is more frequently known under the name of Field Emission Display (FED).

They are used particularly for the manufacture of television screens.

More precisely, the invention relates to a manufacturing process that manages, checks, and maintains a hydrogen pressure inside the device, this pressure being within a range from about $10^{-5}$ Pa to about 1 Pa.

2. State of Prior Art

Microtip screens are flat cathode ray tubes that operate under a vacuum.

These screens comprise a cathode (formed particularly of cathodic conductors, grids and microtips), and an anode (formed of conductors and phosphors).

The life of cathodes (related to the drop in electron current as a function of time) depends very much on the quantity and nature of the residual gases present in this type of screen.

The very flat structure of the screen means that its volume and conductance are very low.

Degassing, which is done mainly from the anode by the effect of electronic bombardment, depends very much on the nature of the phosphors composing the anode.

Consequently, it is very difficult to control and characterize the quality of the vacuum inside the screen.

Experience shows that with some phosphors and optimized degassing and assembly procedures, cathodes may have lives exceeding 10 000 hours.

The lives may be much shorter with other phosphors.

Much more complex, industrially unacceptable, degassing procedures would be necessary to extend these lives.

In the case of colored screens, three different phosphors are necessary to obtain red, green and blue emissions, which makes control of degassing, and therefore of the reliability of cathodes, much more difficult.

The influence of different gases on the emissivity of metallic microtips in molybdenum, which are the most frequently used in Field Emission Displays, have been analyzed.

The clearest results show that oxidizing gases, and particularly oxygen, have a very negative effect on emission.

This effect is largely reversible, which shows that it is due to a surface modification by adsorption or oxidation, of the output work, rather than a change in the configuration of microtips.

Surface analyses of these microtips by Auger microscopy also show a more highly oxidized surface condition in the case of microtips with a degraded electronic emission.

Reducing gasses, particularly hydrogen, have a very significant tendency to improve emissivity, particularly if the hydrogen pressure is higher, up to the range from about $10^{-1}$ Pa to about 1 Pa.

In the presence of a partial hydrogen pressure, the initial emissivity of degraded cathodes is quickly restored, and the emissivity becomes even better than the initial emissivity.

All these results appear consistent.

Hydrogen maintains, or even improves, the metallic state of microtips.

In the case of an oxidizing environment, hydrogen can neutralize this type of environment and make cathodes stable, to a certain extent.

The effect of hydrogen on cathode emissivity has been known for a long time.

The use of this effect in FEDs is more recent.

The authors of this invention have studied the effects of hydrogen in field emitter devices by applying a controlled flow of hydrogen to this type of device (flat screen) while it is in operation and in dynamic pumping in order to maintain a hydrogen pressure in the device of the order of $10^{-5}$ to $5\times10^{-2}$ Pa.

The results obtained confirm the beneficial effect of hydrogen and show that hydrogen can stabilize cathodes even in a degraded environment.

The hydrogen pressures necessary to stabilize cathodes depend on the phosphors used and vary from about $10^{-5}$ Pa to about 1 Pa.

To be usable, a field emitter device must be closed and kept in a vacuum by means of an element known as a getter, as is done for conventional cathode ray tubes.

A getter is a metallic element which, once activated by heating in a vacuum, is capable of fixing gasses desorbed by the device and maintaining the vacuum necessary for the device to operate correctly.

The function of a getter in best known applications is to maintain the vacuum, i.e. to replace a vacuum pump.

There is a two-fold problem to be solved in the case of a field emission screen—the getter must pump oxidizing gasses which is its normal function, but it must also maintain a partial hydrogen pressure of the order of $10^{-5}$ Pa to 1 Pa.

The SAES GETTERS S.P.A. Company, which is specialized in the manufacture of getters, has developed and qualified materials capable of performing this double function.

At the time, it deposited a patent application that describes materials that can be used for this purpose and a process for using these materials in flat screens.

This patent application was deposited in Italy on Jul. 1 1994, under patent application number MI94A001380.

An international application which will be referred to later was subsequently deposited.

Its publication number is WO 96/01492 and its title is "METHOD FOR CREATING AND KEEPING A CONTROLLED ATMOSPHERE IN A FIELD EMITTER DEVICE BY USING A GETTER MATERIAL".

This embodiment process consists of:

making a getter absorb a sufficient and controlled quantity of hydrogen in a special containment, introducing the getter thus hydrogenated into the flat screen before the screen assembly phase, and assemble the screen and heating it to about 450° C. for about 20 minutes.

The screen is put into a vacuum either during the assembly phase or later by means of a duct called an exhaust tube ("tail"), which is then hermetically sealed.

The use of a hydrogenated getter using this known process has a major disadvantage.

During the assembly phase, the getter filled with hydrogen is heated to about 450° C. under a vacuum or in a neutral atmosphere.

Under these conditions, much of the hydrogen is desorbed and the getter is no longer capable of maintaining a high hydrogen pressure after returning to ambient temperature.

In an example described in document WO 96/01492, the final pressure is $4\times10^{-6}$ mbars (about $4\times10^{-4}$ Pa) which is usually not sufficient to stabilize the cathode emission current.

DESCRIPTION OF THE INVENTION

The purpose of this invention is to overcome the disadvantage mentioned above, i.e. the loss of hydrogen during the screen assembly phase.

Its purpose is a process for manufacturing a field emitter device, this process comprising a step to assemble the various elements of the device under a vacuum or controlled atmosphere, this device also comprising at least one getter capable of being hydrogenated, this assembly step itself including a step of positioning of the various elements with respect to each other, an oven drying step of the device, and a sealing step of the device, this process being characterized in that it also includes a hydrogenation step of at least one getter capable of being hydrogenated after the oven drying step.

The getter or getters capable of being hydrogenated may possibly be associated with other more conventional types of getters, for example such as the flashable getter with barium reference ST14 at S.A.E.S. GETTERS S.P.A.

This ST14 getter may be useful to improve the pumping capacity.

According to a first particular embodiment of the process described by the invention, the positioning step, sealing step, a step in which the device is vented to the atmosphere, a vacuum creation step, the oven drying step, the hydrogenation step are carried out in sequence on each getter after the getter has been placed inside the device, followed finally by a step in which the device is closed.

In this case, the getter may be activated before the hydrogenation step. This activation may be done either by the oven drying step itself or later than this oven drying step by any means of heating the getter.

According to a specific embodiment of the invention, the device also includes at least one access duct and the getter is introduced into the device through this access duct.

The getter is preferably inserted after the device has been sealed and vented to the atmosphere again, but it may also be inserted before sealing, which may be useful when several exhaust tubes are to be used (for example, see getter 51 in exhaust tube 29 in FIG. 4 described later on).

In the case of the first specific embodiment of the process, this process may also include a temporary operating step after the oven drying step or after the hydrogenation step.

Also in this case, the process may include repumping of the device, before the final closing step.

According to a second specific embodiment of the process according to the invention, the device is assembled in a vacuum containment, or under a controlled atmosphere, and the step in which the various elements and each getter are positioned, is followed in sequence by the oven drying step and the sealing step, and hydrogen is added into the containment in order to perform the hydrogenation step, after the oven drying step and during and/or before the sealing step.

According to one preferred embodiment of the process according to the invention, each getter to be hydrogenated is chosen among:

- binary alloys comprising a first element chosen among Zr and Ti and a second element chosen among V, Mn, Fe, Co, Ni and Cr,
- ternary alloys comprising a first element chosen among Zr and Ti and second and third elements chosen among V, Mn, Fe, Co, Ni and Cr.

These getters are mentioned in document WO 96/01492, and the reader can refer to this document and particularly to pages 7 and 8 in it, for an example of getters that can be used for making this invention.

Another purpose of this invention is an initial apparatus for embodying the process described in the invention, characterized in that it comprises:

- a pipe,
- first, second and third valves,
- pumping means capable of communicating with the device through the pipe and the first valve,
- a reservoir suitable for communicating with the device through the pipe and the second valve,
- a hydrogen source capable of communicating with the reservoir through the third valve,
- means of measuring the pressure inside the device, and
- means of measuring the pressure in the reservoir.

Another purpose of this invention is a second apparatus for embodiment of the process described in the invention, characterized in that it comprises:

- a containment,
- means of oven drying and assembling the device when it is placed in the containment,
- a pipe,
- first and second valves,
- pumping means communicating with the containment through the pipe and the first valve,
- a hydrogen source communicating with the containment through the second valve,
- means of measuring the pressure in the containment in the absence of hydrogen in it, and
- means of measuring the pressure in the containment when hydrogen has been added into it.

BRIEF DESCRIPTION OF THE FIGURES

This invention will be better understood by reading the description of example embodiments given below, for guidance only and in no way restrictive, and by referring to the attached drawings in which.

DETAILED DESCRIPTION OF SPECIFIC EMBODIMENTS

We will now describe a first specific embodiment of the process described in the invention, but we will firstly make a few reminders about the structure of field emitter devices.

Figure 1:
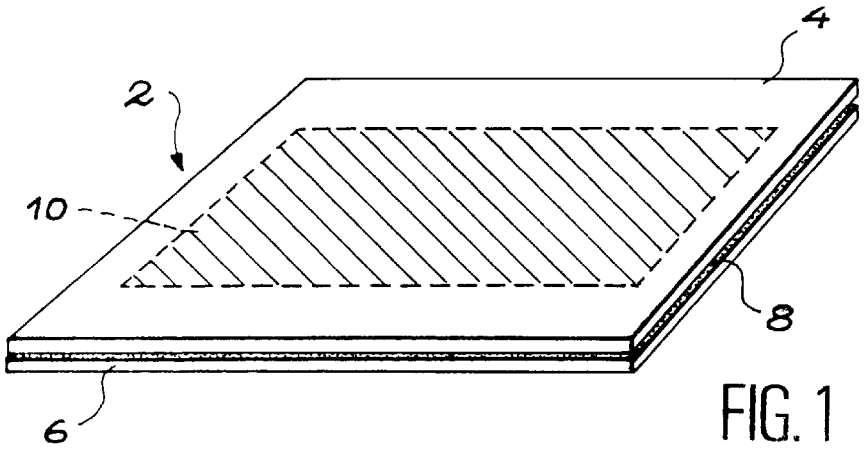
FIG. 1 PRIOR ART
FIG. 1 is a perspective schematic view of a field emitter device.

An example field emitter device is schematically shown in perspective in FIG. 1.

This device 2 in FIG. 1 comprises a front part 4 made of glass and a back part 6 also made of glass.

These parts 4 and 6 are sealed around their periphery by means of a glass paste 8 with a low melting point.

FIG. 1 also shows the cross hatched area 10, in which phosphors are placed on the inside surface of the front part 4.

Figure 2:
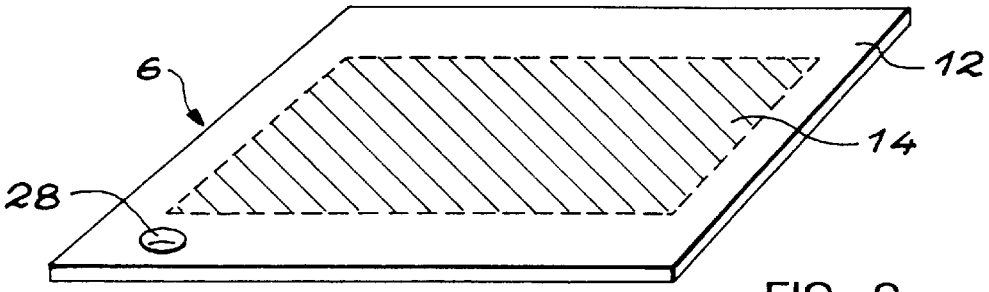
FIG. 2 PRIOR ART
FIG. 2 is a perspective schematic view of the back of this device.

FIG. 2 is a schematic perspective view of the inner surface 12 of the back part of the device in FIG. 1.

This FIG. 2 shows area 14 which is opposite to area 10 inside device 2, and on which the cathode and therefore the microtips are located.

The microtips are formed using microelectronics techniques and their density may be as high as a few tens of thousands of microtips per square millimeter.

Figure 3:
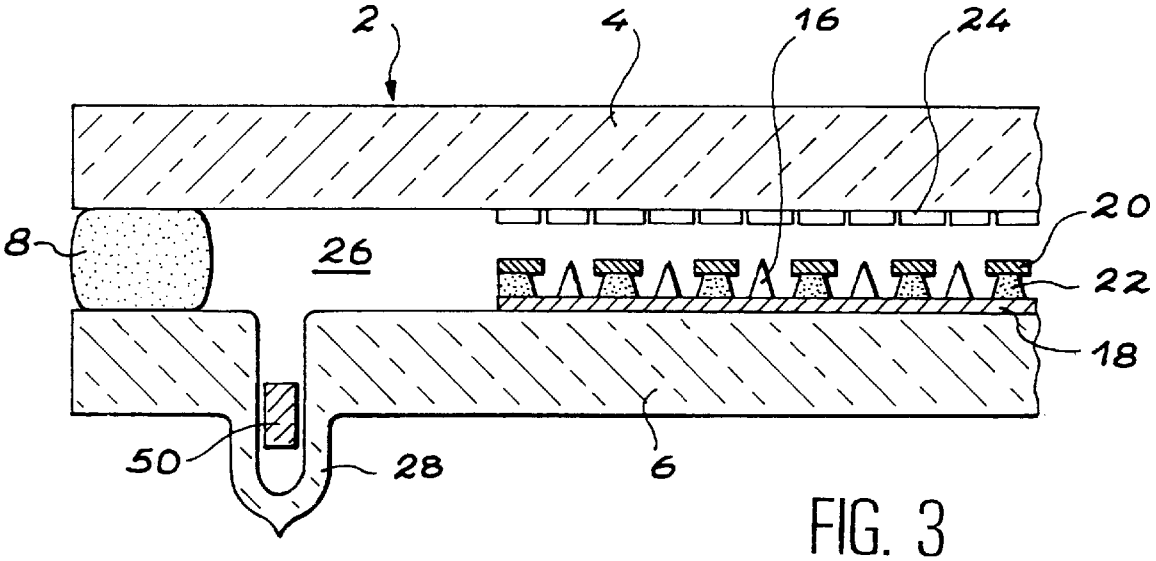
FIG. 3 PRIOR ART
FIG. 3 is a schematic cross-sectional view of the device in FIG. 1.

FIG. 3 is a schematic cross-sectional view of device 2 which is shown in FIG. 1.

This FIG. 3 shows microtips 16 formed preferably on a resistive layer such as a silicon layer 18 deposited on cathodic conductors, grid electrodes 20 separated from layer 18 by a layer 22 of dielectric material, phosphors 24 and the inner space 26 of device 2.

This space must be kept under a vacuum or a controlled atmosphere, for example hydrogen.

As can be seen in FIG. 3, the device 2 may be provided with one or several ducts called "exhaust tubes", that are generally made of glass.

The exhaust tube 28 shown in FIG. 3 is closed.

When it is open, it can be used to create a vacuum in the space 26 in device 2 and to insert the getter or getters such as getter 50, and possibly an appropriate gas in this space 26.

We will now describe a first process according to the invention.

According to this first process, a field emitter device, for example such as that already described in reference to FIGS. 1 to 3, is positioned and sealed under vacuum or under a controlled atmosphere (for example an argon atmosphere) by heating to a temperature of between 400° C. and 650° C. for about 1 hour.

This device is equipped with an exhaust tube or several exhaust tubes.

At least one of these exhaust tubes is open.

The sealing wall (reference 8 in FIG. 1) of the two parts of the device is made of a glass with a low melting point called "frit glass".

After sealing and venting to the atmosphere again, at least one specific getter that is not yet hydrogenated is inserted inside the exhaust tube (or one of the exhaust tubes).

However, the getter or getters is (are) not necessarily positioned in the exhaust tubes, but may also be inserted in the screen.

This getter (or these getters) will for example be of the type marketed by the SAES GETTER S.P.A. company reference St 909, St 707 and St 737.

The device is then mounted on equipment that is used to pump and oven dry it at about 400° C. for several hours.

During this oven drying phase, the getter is activated, i.e. it is made capable of pumping oxidizing gasses and adsorbing a large quantity of hydrogen.

After returning to ambient temperature, the device may be put into operation for several hours to degass the phosphors under dynamic pumping (burn-in phase).

Note that this operating phase is not compulsory.

Furthermore, it may take place in the presence of hydrogen, for example under a pressure of the order of $10^{-3}$ Pa to $10^{-1}$ Pa.

But this is not compulsory either

Finally, a quantity of calibrated hydrogen is added into the device.

Hydrogen can also be added before the previous operating phase.

The getter adsorbs this hydrogen in a time varying between a few minutes and an hour.

The hydrogen equilibrium pressure may vary from approximately $10^{-5}$ Pa to 1 Pa, depending on the quantity added.

A vacuum can then be made in the device, but this is not compulsory.

This device is then closed by closing the open exhaust tube by local heating.

The advantage of this first process according to the invention compared with prior art described in document WO 96/01492 is due to the fact that the getter is not heated after having been charged with hydrogen.

In this way, all the added hydrogen is kept, and a high equilibrium pressure is maintained in the device exceeding about $10^{-3}$ Pa, and possibly as high as about 1 Pa.

One beneficial alternative embodiment is to keep the getters cold and inactive during the oven drying phase, and possibly the burn-in phase. Thus they will not be unnecessarily partially saturated prematurely by degassing flows that take place during these phases. In this case, activation takes place just before hydrogenation by an appropriate heating means, and for example using inductive heating that is capable of locally heating the getter.

Figure 4:
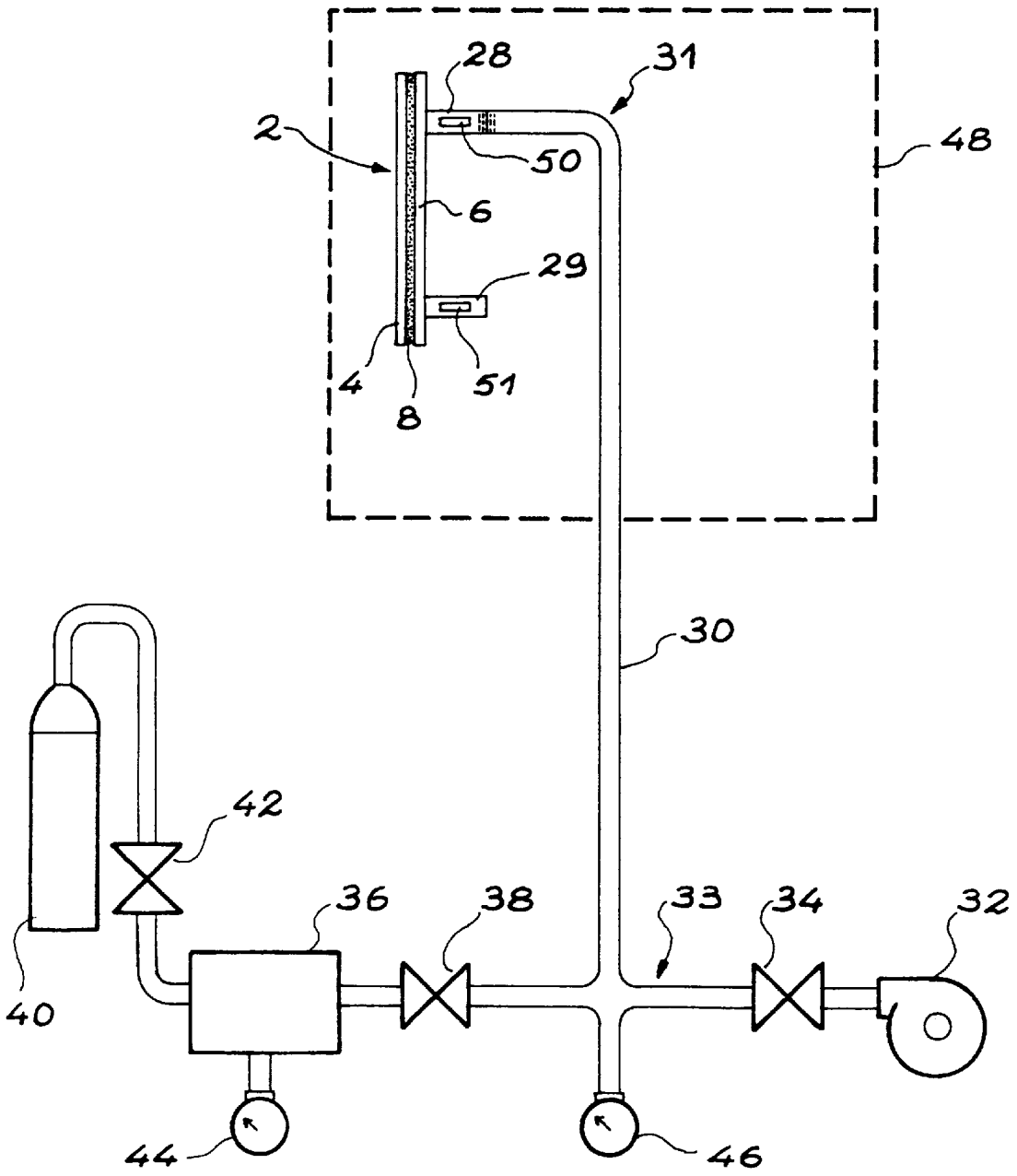
FIG. 4 is a schematic view of a first apparatus for embodying the process described in the invention.

FIG. 4 shows a schematic view of an apparatus according to the invention, that enables embodiment of the first process that has just been described.

This apparatus can give a finished field emitter device like the device 2 shown in FIG. 1.

This apparatus in FIG. 4 comprises:

- a pipe 30 designed to be connected to one end 31 of device 2 through exhaust tube 28,
- a turbo-molecular type pumping system 32 connected to the other end 33 of pipe 30, through a valve 34,
- a reservoir 36 with a volume equal to 0.714 liters in the example shown, and which is connected at one end to the other end 33 of pipe 30 through a valve 38, and at the other end to a hydrogen cylinder 40 through a needle valve 42 with variable flow,
- a membrane gauge 44 designed to measure the pressure in the reservoir 36, and for example of the Baratron type, in order to measure pressures in the range varying from about 1 Pa to about $10^3$ Pa, and
- a pressure gauge 46 connected to the other end 33 of pipe 30 (like valves 34 and 38), this gauge 46 being for example of the type marketed by the Bayer Alper company and capable of measuring the pressures within the range from about $10^{-8}$ Pa to about $10^{-1}$ Pa.

Note that the device 2 is placed in an area 48 in which this device 2 can be oven dried.

Valve 34 isolates device 2 from pump 32 and valve 38 isolates this device 2 from reservoir 36.

Hydrogen may be added into reservoir 36 from cylinder 40 and through needle valve 42 that is used for fine adjustment of the hydrogen flow.

Gauge 46 checks the pressure at the output from device 2 and the membrane gauge 44 measures the hydrogen pressure in reservoir 36.

The first process according to the invention is embodied starting by fixing (by means not shown) a getter 50 into the exhaust tube 28.

For example, this getter may be of the type marketed by the SAES GETTERS S.P.A. company as reference St 737.

As a variant, several getters may be placed in exhaust tube 28.

Obviously, this exhaust tube 28 has previously been opened.

As an alternative, as shown in FIG. 4, the device 2 comprises two exhaust tubes 28 and 29 instead of a single exhaust tube, and two getters 50 and 51 are placed in these exhaust tubes.

After closing the additional exhaust tube 29, if any, the end 31 of the pipe 30 is connected to the exhaust tube 28 by welding.

Exhaust tube 29 is preferably closed with its getter or getters inserted before the positioning step.

A vacuum is created in device 2 and reservoir 36 by means of pump 32, valves 34 and 38 then being opened and valve 42 closed.

A heat treatment is then carried out in order to degas device 2 and to activate the getter or getters.

The device 2 is oven dried for 16 hours at 360° C.

This temperature is reached by using a temperature ramp of about 1° C. per minute After cooling to ambient temperature, the device 2 is put into operation (electrical test) for 20 hours.

After this operating phase has stopped, the reservoir 36 is isolated from device 2 by closing valve 38.

Device 2 is isolated from the vacuum pump 32 by closing valve 34.

Valve 42 is open.

Hydrogen is added into reservoir 36 at a pressure of 470 Pa.

Valve 42 is closed.

Valve 38 is then open and the hydrogen is adsorbed by the getter or getters.

About 30 minutes are necessary to carry out this adsorption.

A vacuum is created in device 2 again and reservoir 36 for about 5 minutes by opening valve 34.

Device 2 is then permanently closed and it is separated from pipe 30 by closing exhaust tube 28.

The hydrogen pressure inside the device is then measured and exceeds $10^{-2}$ Pa.

We will now explain a second process according to the invention.

With this second process according to the invention, the field emitter device is sealed in an "integral" manner.

This means that the device is degassed and sealed under a vacuum.

This second process is such that after the field emitter device is sealed, it remains under a vacuum unlike the previous case in which, after sealing, the device is restored to atmospheric pressure and a vacuum is then created again and is oven dried.

This second process according to the invention includes the following phases.

The various elements of the field emitter device (plate supporting the anode, plate supporting the cathode, sealing glass, getter or getters, are put under a vacuum and are then oven dried at a temperature of the order of 300° C. to 450° C. for one or several hours.

Note that the getter or getters may be hydrogenated at this stage, although there is no point since in any case a subsequent hydrogenation step is necessary.

The device may be equipped with one or several closed exhaust tubes that contain the getter or getters.

The device does not necessarily include any exhaust tubes.

In this case, the getter or getters must be sufficiently flat so that they can be inserted inside the field emitter device on the sides of its active area, and possibly in a groove formed in one of the glass plates in the device.

During the oven drying phase, the plate supporting the anode may be put into contact with the plate supporting the cathode, or it may be separated from it.

Degassing is better if it is separated.

After the oven drying phase, the containment in which the field emitter device was placed is increased to a hydrogen pressure of between 10 Pa and $10^5$ Pa.

This containment may or may not be isolated from its pumping means.

As an alternative, the getter or getters are previously charged with a known quantity of hydrogen using suitable means.

The plate supporting the anode and the plate supporting the cathode are then put into contact with each other (if they were not already in contact) and the field emitter device (for example of the type shown in FIGS. 1 and 3) is then sealed at a previously established hydrogen pressure, at a temperature of between 400° C. and 650° C. for about 1 hour.

During the cooling phase, the getter adsorbs (or the getters adsorb) the hydrogen trapped in the device and maintain an equilibrium pressure that depends mainly on the hydrogen pressure imposed during the sealing phase, the volume of the device and the quantity and type of getter or getters.

The advantage of this second process according to the invention, compared with prior art described in document WO-96/01 492, is that it can maintain a large dose of hydrogen in the getter or getters during the sealing phase by doing the sealing at a high hydrogen pressure.

Figure 5:
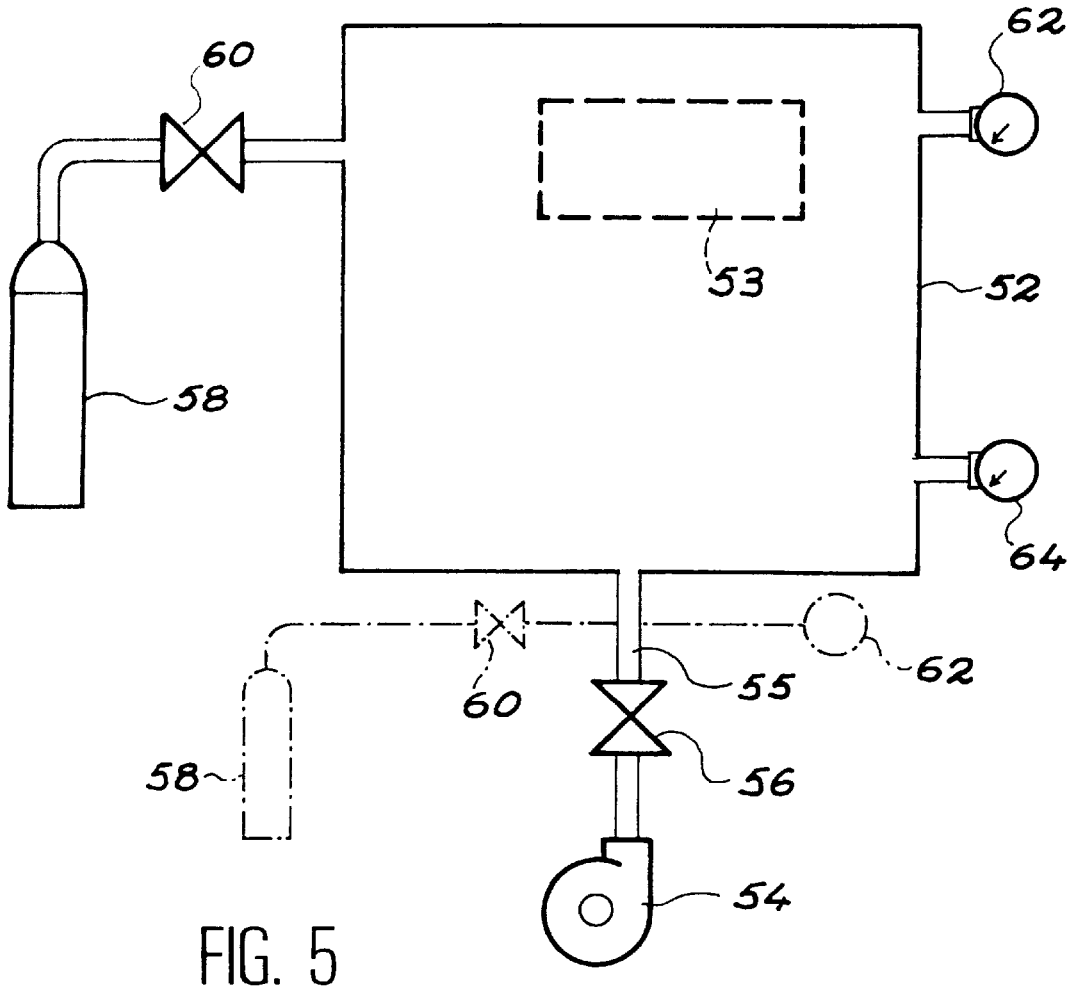
FIG. 5 is a schematic view of a second apparatus for embodying the process described in the invention.

We will now describe an apparatus for embodiment of this second process according to the invention, with reference to FIG. 5.

The apparatus schematically shown in FIG. 5 comprises a containment 52 used for oven drying and assembly of the field emitter device.

This containment 52 is equipped with appropriate electrical and mechanical means 53 enabling this oven drying and assembly of the device.

The apparatus in FIG. 5 also includes a turbo-molecular pumping unit 54 that communicates with the inside of the containment 52 through a pipe 55 on which a valve 56 is mounted.

Furthermore, this apparatus comprises a hydrogen cylinder 58 that communicates with the inside of the containment 52 through a variable flow needle valve 60.

Valve 56 isolates the containment 52 from the pumping unit 54.

Valve 60 is used to add hydrogen into containment 52 in a controlled manner.

The apparatus in FIG. 5 also includes a secondary gauge 62 similar to those marketed by the Bayer Alper company, capable of measuring pressures varying from $10^{-8}$ Pa to $10^1$ Pa.

This gauge 62 is used to check the vacuum in containment 52.

The apparatus in FIG. 5 also comprises a primary gauge 64 for measuring pressures within the range varying from 10 Pa and $10^5$ Pa.

This gauge 64 is capable of measuring the hydrogen pressure in containment 52 while the field emitter device is being sealed.

The various elements of the device are put into position in containment 52.

The plate supporting the anode of the device is separated from the plate supporting the cathode by a distance of 1 cm.

Figure 6:
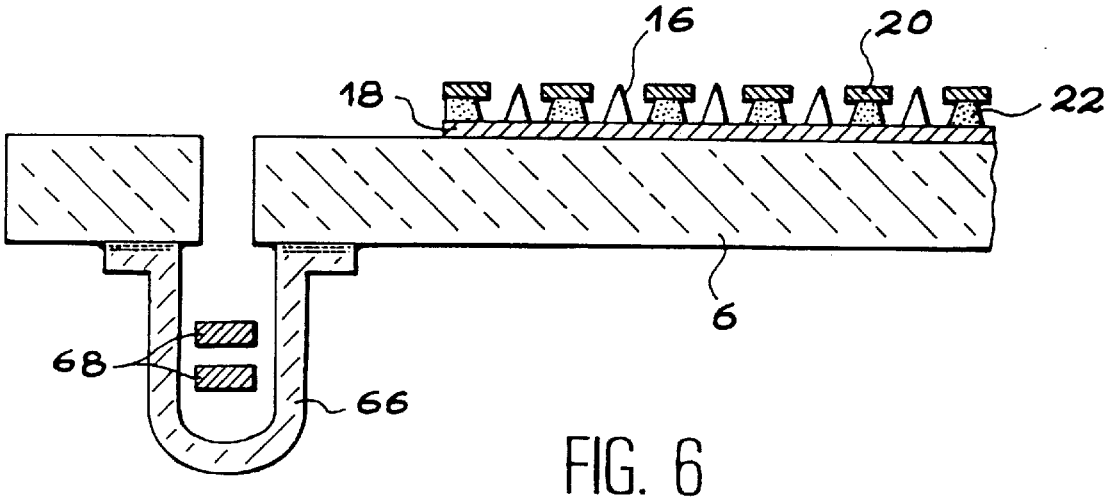
FIG. 6 is a schematic and partial cross-sectional view of a device to be processed in the apparatus in FIG. 5.

As can be seen in FIG. 6, a closed exhaust tube 66 is welded to the back of plate 6 supporting the cathode of the device.

This exhaust tube 66 contains two getters 68, for example of type St 737 mentioned above.

A hole 70 has previously been drilled in plate 6 at the exhaust tube 66 to form a communication between the device and this exhaust tube 66.

The pumping unit 54 is used to create a vacuum in containment 52, valve 56 being opened and valve 60 being closed.

The various elements in the field emitter device are oven dried for 16 hours at 360° C.

The plate supporting the anode and the plate supporting the cathode of the field emitter device are then brought into contact with each other.

Valve 56 is closed and containment 52 is filled with hydrogen by opening valve 60.

When the hydrogen pressure has stabilized at $10^4$ Pa, valve 60 is closed again.

The temperature of the containment is increased to 450° C. for 1 hour so that elements in the field emitter device can be assembled.

After cooling to ambient temperature, valve 56 is opened and the hydrogen contained in the containment 52 is repumped.

Valve 56 is closed again and the atmospheric pressure is restored in containment 52 by adding nitrogen into it using appropriate means not shown.

The device is then removed from containment 52.

It is then ready to be put into operation.

The advantage of the second process according to the invention compared with the process described in document WO 96/01492 lies in the fact that the sealing is done at a high hydrogen pressure of up to $10^5$ Pa, so that a sufficient quantity of hydrogen can be added into and maintained in the getter or getters, so that an equilibrium pressure equal to or greater than approximately $10^{-3}$ Pa can be maintained in the device.

Furthermore, this second process is simpler than the first process since it only requires a single pumping step whereas the first process conform with the invention usually requires two.

In an alternative embodiment of the apparatus in FIG. 5, which is shown in chain dotted lines in FIG. 5, the secondary gauge 62 is installed on the portion of the pipe 55 between valve 56 and containment 52, and the hydrogen cylinder 58 communicates with this portion of the pipe through valve 60.

We claim:

1. Process for manufacturing a field emitter device (2), this process comprising a step of assembling the various elements of the device under a vacuum or under a controlled atmosphere, this device comprising at least one getter (50, 51; 68) suitable for being hydrogenated, this assembly step itself including a step in which the various elements are positioned with respect to each other, a device oven drying step and a device sealing step, this process being characterized in that it also comprises a hydrogenation step of at least one getter suitable for being hydrogenated after the oven drying step.

2. Process according to claim 1, characterized in that the positioning step, the sealing step, a step in which the device is vented into the atmosphere, a device vacuum creation step, the oven drying step, the hydrogenation step for each getter after it has been placed in the device, and a device closing step, are carried out in sequence.

3. Process according to claim 2, characterized in that the getter is activated before the hydrogenation step.

4. Process according to claim 2, characterized in that the device also comprises at least one access duct (28, 29; 66), and that the getter is placed in the device through this access duct.

5. Process according to claim 2, characterized in that the getter is added after sealing and venting the device into the atmosphere again.

6. Process according to claim 2, characterized in that the getter is added before the device is sealed.

7. Process according to claim 2, characterized in that it also includes a temporary operation step after the oven drying step or the hydrogenation step.

8. Process according to claim 2, characterized in that it also includes a repumping step of the device (2) before the closing step of the device.

9. Process according to claim 1, characterized in that the device is assembled in a containment (52) under a vacuum or a controlled atmosphere, that the positioning step of the various elements and each getter, the oven drying step and the sealing step are carried out in sequence, and that hydrogen is added into the containment in order to carry out the hydrogenation step after the oven drying step and during and/or before the sealing step.

10. Process according to claim 1, characterized in that each getter to be hydrogenated (50, 51; 68) is chosen from among:

binary alloys comprising a first element chosen among Zr and Ti and a second element chosen among V, Mn, Fe, Co, Ni and Cr, ternary alloys comprising a first element chosen among Zr and Ti and second and third elements chosen among V, Mn, Fe, Co, Ni and Cr.

11. Apparatus for embodiment of the process according to claim 2, characterized in that it comprises:

a pipe (30), first, second and third valves (34, 38, 42), pumping means (32) capable of communicating with the device (2) through the pipe (30) and the first valve (34), a reservoir (36) capable of communicating with the device (2) through the pipe (30) and the second valve (38), a hydrogen source (40) capable of communicating with the reservoir through the third valve (42), means (46) of measuring the pressure inside the device (2), and means (44) of measuring the pressure in the reservoir (36).

12. Device for embodiment of the process according to claim 9, characterized in that it comprises:

a containment (52), means (53) of oven drying and assembling the device when it is placed in the containment, a pipe (55), first and second valves (56, 60), pumping means (54) communicating with the containment (52) through the pipe (55) and the first valve (56), a hydrogen source (58) communicating with the containment (52) through the second valve (60), means (62) of measuring the pressure in the containment in the absence of hydrogen in the containment, and means (64) of measuring the pressure in the containment when hydrogen has been added into the containment.

* * * * *